US008371955B2

(12) United States Patent
Matsunaga

(10) Patent No.: US 8,371,955 B2
(45) Date of Patent: Feb. 12, 2013

(54) WOOD-TYPE GOLF CLUB SET

(75) Inventor: Kiyofumi Matsunaga, Kobe (JP)

(73) Assignee: SRI Sports Limited, Kobe (JP)

( * ) Notice: Subject to any disclaimer, the term of this patent is extended or adjusted under 35 U.S.C. 154(b) by 358 days.

(21) Appl. No.: 12/767,200

(22) Filed: Apr. 26, 2010

(65) Prior Publication Data

US 2010/0273566 A1 Oct. 28, 2010

(30) Foreign Application Priority Data

Apr. 27, 2009 (JP) ..... 2009-108113

(51) Int. Cl.
*A63B 53/04* (2006.01)

(52) U.S. Cl. ..... 473/290; 473/342; 473/345

(58) Field of Classification Search ..... 473/289–291
See application file for complete search history.

(56) References Cited

U.S. PATENT DOCUMENTS 6,475,099 B1 * 11/2002 Sumitomo et al. ..... 473/290
7,147,570 B2 * 12/2006 Toulon et al. ..... 473/290

FOREIGN PATENT DOCUMENTS

JP 2000-262655 A 9/2000

* cited by examiner

*Primary Examiner* — Stephen L. Blau
(74) *Attorney, Agent, or Firm* — Birch, Stewart, Kolasch & Birch, LLP

(57) ABSTRACT

A set of wood-type golf clubs having different club-lengths is disclosed. In order to decrease variations in the ball flying directions among the clubs, each of the wood-type golf clubs has a club-length WL in inches, a toe-side crown width L1 in millimeter, an overall crown width L in millimeter, and a crown tilt angle α2 in degree which satisfy the following conditional expressions: $0.75=<\{(L1/L)+0.01\times WL\}=<0.95$, and $-22.5=<(\alpha 2-0.65\times WL)=<-20.5$.

15 Claims, 7 Drawing Sheets

WOOD-TYPE GOLF CLUB SET

BACKGROUND OF THE INVENTION

The present invention relates to a set of wood-type golf clubs having different club-lengths, more particularly to an improvement in a shape of the head of each club viewed from the golfer's eyes capable of providing an easy golf swing without the need to pay a special attraction to the difference in the club-length.

Heretofore, in order to make a golf club easy to swing and use, various attempts and efforts have been made by optimizing mechanical characteristics, e.g. the position of the center of gravity of the head, a moment of inertia of the head, the bending rigidity of the shaft, the bend profile of the shaft and the like so as to improve the golf club itself and/or to adjust it to the target users.

On the other hand, as well known empirically, golf club swing is easily affected by mental factors of the golfer.

In particular, visual impressions of the golf club given to the golfer at address affects golf club swing. More specifically, the golf club swing is largely affected by the shape of the crown portion of the club head to which the golfer pays particular attention.

In Japanese Patent application publication JP-2000-262655A, the assignee of the present invention proposed a golf club, in which three parameters of a golf club head (which are the undermentioned toe-side crown width L1, angle α1, angle α2) are limited within specific ranges.

A golf club having such golf club head is hard to give the golfer at address such impression that the golf club is considerably upright or considerably flat. Accordingly, the golfer can swing with an easy mind, therefore, stable and balanced swing is possible, and a decrease of missed shots may be expected.

Aiming at a further improvement of a golf club in which the club head of JP-2000-262655A is incorporated, the inventor of the present invention studied and recognized the importance of a visual impression of the golf club at address relative to the lie angle and club-length.

As a general rule, in the case of a golf club having a shorter club-length, the lie angle of the golf club becomes larger, and accordingly, a visual impression which the golfer receives from the golf club at address becomes more upright. In general, an upright address puts the golfer in mind of an upright swing, therefore, the golfer tends to worry about the possibility of making a hook shot.

On the other hand, in the case of a golf club having a longer club-length, the lie angle of the golf club becomes smaller, and accordingly, a visual impression which the golfer receives from the golf club at address becomes more flat. In general, a flat address puts the golfer in mind of a flat swing, therefore, the golfer tends to worry about the possibility of making a slice shot.

Therefore, golf clubs, especially wood-type golf clubs (namely, driving clubs such as driver, fairway woods and utility woods), which are combined into a golf club set, have to present unified visual impressions controlled such that a golf club having a shorter club-length gives an impression of flatter address than the real lie angle, and a golf club having a longer club-length gives an impression of more upright address than the real lie angle.

By controlling the visual impressions in this way, even if the club-length is changed, the golfer can use and swing the club easily without worrying about a slice shot and a hook shot.

SUMMARY OF THE INVENTION

It is therefor, an object of the present invention to provide a set of wood-type golf clubs, in which a golfer can use and swing the golf clubs easily without special attention to the difference in the club-length, thus missed shots such as slice shot and hook shot can be effectively prevented, and a carry distance loss thereby is minimized.

According to the present invention, a set of wood-type golf clubs have different club-lengths, and the wood-type golf clubs each satisfy the following conditional expressions:

$$0.75=<\{(L1/L)+0.01\times WL\}=<0.95$$

and $$-22.5=<(\alpha 2-0.65\times WL)=<-20.5$$

wherein, the parameters L1, L, WL, α2 of each of the golf clubs are defined under the standard state of the golf club as follows.

In this application (including the description and claims):— the term "wood-type golf club" means a driver (#1 wood), fairway woods (including at least #2-#5 woods) and utility woods whose head shapes are similar to those of the fairway woods, wherein the wood-type golf club is composed of a shaft, a grip and a club head. The club head comprise a clubface, a crown portion, a sole portion, a side portion, and a hosel neck portion;

the standard state is such that the club head is placed on a horizontal plane HP so that the club face angle becomes zero, and the center line (CL) of the shaft (2) becomes inclined at the lie angle θ with respect to the horizontal plane HP, while keeping the center line (CL) within a vertical plane VP;

the parameter L1 (hereinafter, the toe-side crown width L1) is a distance in millimeter measured in the horizontal direction between the toe-side extreme end point Q of the head and the highest point P of the crown portion of the head, both points on the profile line of the cross section of the head taken along the vertical plane VP;

the parameter L (hereinafter, the overall crown width L) is a distance in millimeter measured in the horizontal direction between the toe-side extreme end point Q and the neck-side lowest point R of the crown portion occurred on the hosel neck portion side on the above-mentioned profile line;

the parameter WL (hereinafter, the club-length WL) is a club-length in inch measured along the center line (CL) of the shaft (2) from the butt end (2*e*) of the shaft (not the end of the grip) to a heel point H at a height h of 0.875 inch (22.23 mm) from the horizontal plane HP;

the parameter α2 (hereinafter, the crown tilt angle α2) is an angle in degree of a straight line drawn between the highest point P and the neck-side lowest point R with respect to the horizontal direction;

the undermentioned toe-side crown angle α1 is an angle of a straight line drawn between the toe-side extreme end point Q and the highest point P with respect to the horizontal direction;

various dimensions, positions and the like of the club refer to those under the standard state unless otherwise noted; and various heights refers to those measured from the horizontal plane HP under the standard state unless otherwise noted.

In the present invention, by satisfying the above-mentioned conditional expressions, the shape of the crown portion viewed from the golfer's eyes is altered according to the club-length, and gives the golfer an impression such that it is not necessary to pay special attractions to the difference on the club-length. Therefore, the golfer can swing the clubs with an easy mind and hit a ball therewith and can decrease missed shots.

DESCRIPTION OF THE PREFERRED EMBODIMENTS

Embodiments of present invention will now be described in detail in conjunction with accompanying drawings.

According to the present invention, a wood-type golf club set S includes at least three wood-type golf clubs (1A, 1B and 1C, generically, "1") having different club-lengths.

The number of the golf clubs constituting the set S is at least 3, advantageously at least 4, more advantageously at least 5. There is no upper limit, but in practice, the upper limit is 10 or so.

All of the golf clubs constituting the set S are provided with an identical brand name, trademark or the like to indicate a series of golf clubs.

Figure 1:
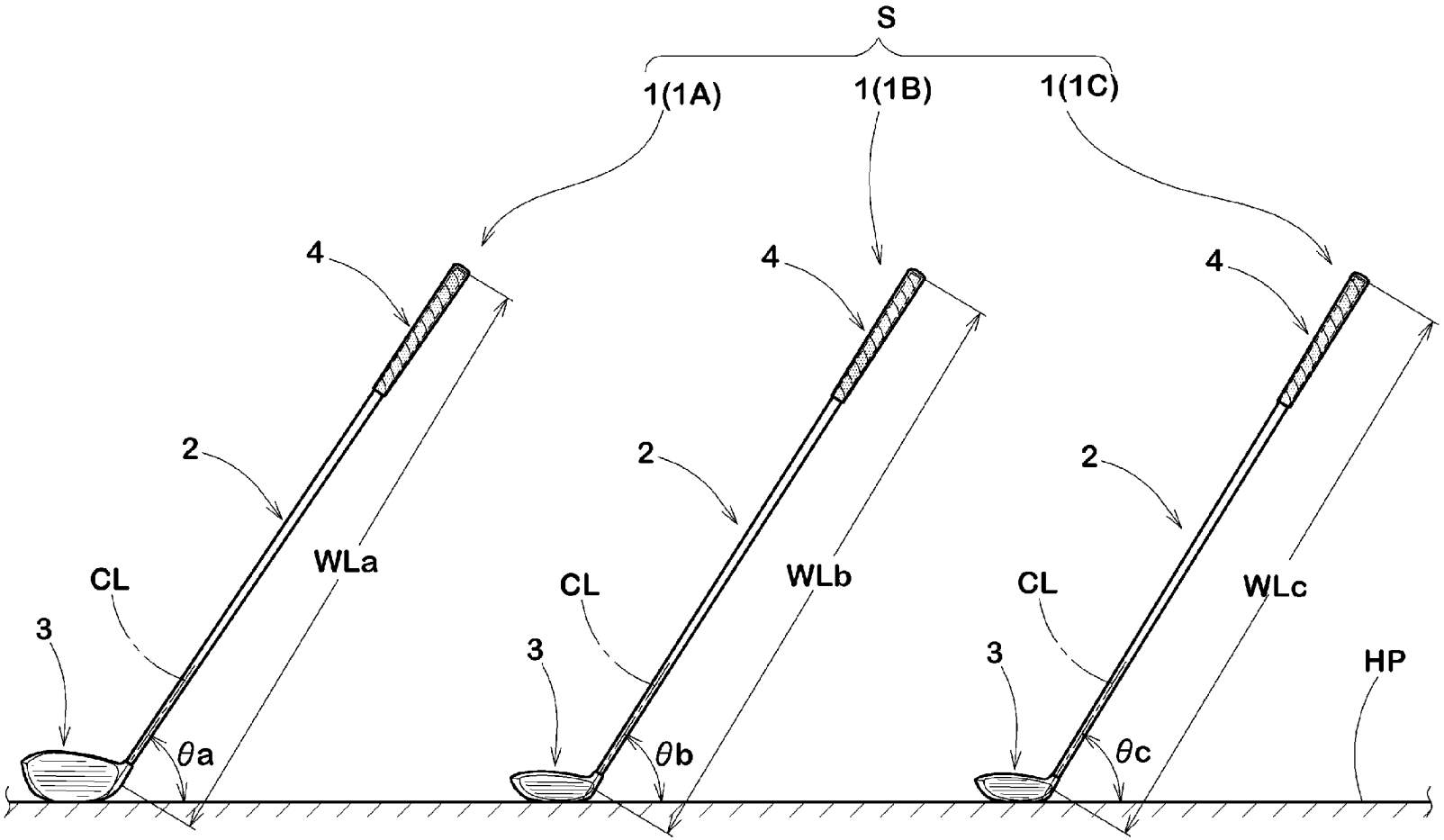
FIG. 1 is a front view of a set of wood-type golf clubs laid side-by-side under the respective standard states.
Figure 2A:
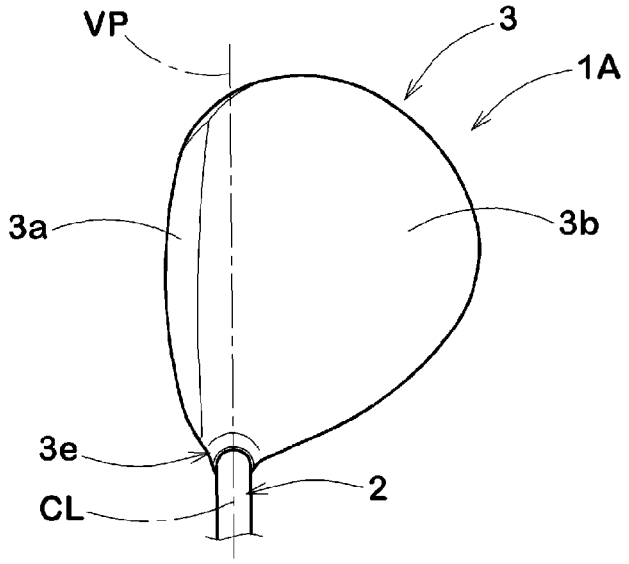
FIGS. 2(*a*), 2(*b*) and 2(*c*) are plan views of the heads of the wood-type golf clubs.
Figure 2B:
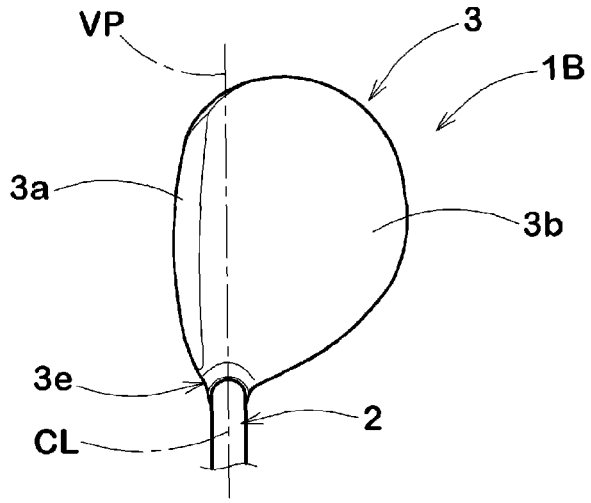
Figure 2C:
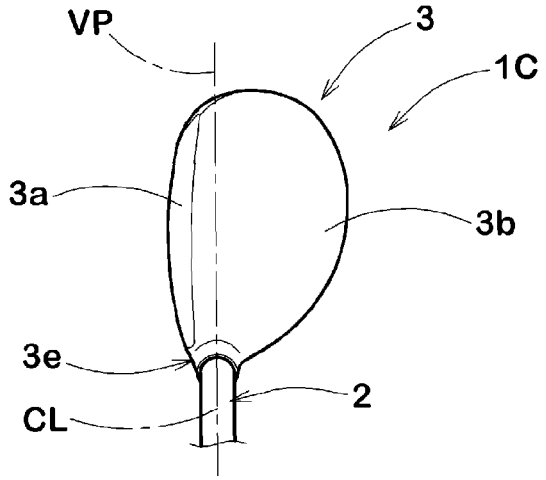

In FIG. 1 and FIG. 2, the golf clubs 1A, 1B and 1C are a driver, fairway wood and utility wood, respectively.

Aside from this combination, various combinations are possible, for example, a combination of: (a) a plurality of fairway woods; (b) a plurality of utility woods; (c) a driver plus (a); (d) (a) plus (b); (e) a driver plus (d) or the like.

The golf club 1 is composed of a shaft 2, a club head 3 attached to the tip end of the shaft 2, and a grip 4 attached to the butt end of the shaft 2.

Figure 3:
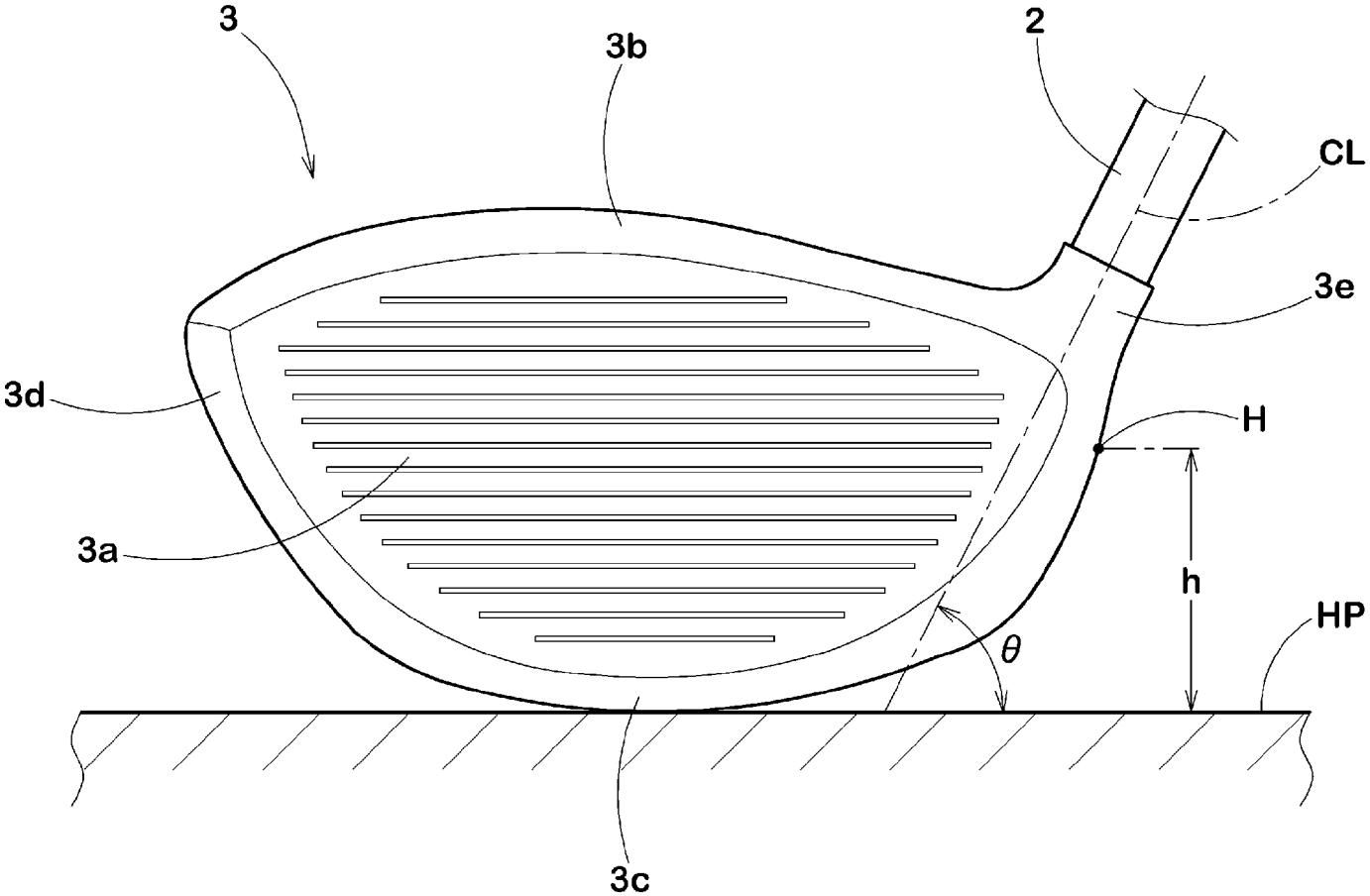
FIG. 3 is a front view of one of the heads.

The club head 3 comprise, as shown in FIG. 3, a clubface 3*a* for hitting a golf ball, a crown portion 3*b* defining a club head's upper surface intersecting the clubface 3*a* at the upper edge thereof, a sole portion 3*c* defining a club head bottom face intersecting the clubface 3*a* at the lower edge thereof, a side portion 3*d* between the crown portion 3*b* and sole portion 3*c*, extending from a toe-side edge to a heel-side edge of the clubface 3*a* through a back face of the head, and a hosel neck portion 3*e* located on the heel-side of the crown portion 3*b*, attached to the tip end of the shaft 2. The crown portion 3*b* is convexly smoothly curved and becomes gradually lower towards the back face side.

The club head 3 has a hollow structure made from one or two or more kinds of metal materials selected from pure titanium, titanium alloys, stainless steels, aluminum alloys (e.g. duralumin) for example. Incidentally, resin or plastic, fiber reinforced resin or plastic or the like may be used to form a part of the hollow structure if needed.

The golf clubs (1A-1C) in the set S satisfy the following relationships on the club-length WL, loft angle β, lie angle θ, head volume V and head mass m:

$$WLa > WLb > WLc$$

$$\beta a < \beta b < \beta c$$

$$\theta a < \theta b < \theta c$$

$$Va > Vb > Vc$$

$$ma < mb < mc$$

wherein, the suffixes "a", "b" and "c" correspond to the golf clubs 1A, 1B and 1C, respectively.

Thus, the loft angle β, lie angle θ and head mass are increased as the club-length WL is decreased. And the head volume V is decreased as the club-length is decreased.

When the number "n" of the golf clubs 1 is more than 3, these relationships are expressed as follows.

Given that the golf clubs 1 constituting the set S are numbered in the descending order of the club-length WL from 1 to n, and the club-length WL, loft angle β, lie angle θ, head volume V and head mass m of a golf club whose assigned number is "x" are expressed as WL(x), β(x), θ(x), V(x), and m(x), respectively, the following relationships are satisfied:

$$WL(x) > WL(x+1),$$

$$\beta(x) < \beta(x+1),$$

$$\theta(x) < \theta(x+1),$$

$$V(x) > V(x+1) \text{ and}$$

$$m(x) =< m(x+1).$$

In any way, it is desirable that these parameters are specifically limited as follows.

Club-length WL: If the club-length WL is short, there is a possibility that the head speed becomes insufficient. If the club-length WL is too long, it becomes difficult to use or swing the club.

Therefore, in the case of a driver, the club-length WL is preferably not less than 43.5 inch, more preferably not less than 44.0 inch, still more preferably not less than 44.5 inch, but not more than 48.0 inch, more preferably not more than 47.0 inch, still more preferably not more than 46.0 inch.

In the case of a fairway wood, the club-length WL is preferably not less than 39.0 inch, more preferably not less than 39.5 inch, still more preferably not less than 40.0 inch, but not more than 44.0 inch, more preferably not more than 43.5 inch, still more preferably not more than 43.0 inch.

In the case of a utility wood, the club-length WL is preferably not less than 38.0 inch, more preferably not less than 39.0 inch, still more preferably not less than 39.5 inch, but not more than 42.0 inch, more preferably not more than 41.5 inch, still more preferably not more than 41.0 inch.

Loft angle β: If the loft angle β is too small, it becomes difficult to drive the ball high in order to obtain appropriate flying distances required for the respective clubs. If the loft angle is too large, on the other hand, the ball tends to rise high contrary to expectation and the flying distance of the ball decreases.

Therefore, in the case of a driver, the loft angle is preferably not less than 7.5 degrees, more preferably not less than 8.5 degrees, still more preferably not less than 9.0 degrees, but not more than 16.0 degrees, more preferably not more than 15.0 degrees, still more preferably not more than 14.0 decrees.

In the case of a fairway wood, the loft angle is preferably not less than 11.0 degrees, more preferably not less than 12.0 degrees, still more preferably not less than 13.0 degrees, but not more than 26.0 degrees, more preferably not more than 25.0 degrees, still more preferably not more than 24.0 degrees.

In the case of a utility wood, the loft angle is preferably not less than 15.0 degrees, more preferably not less than 16.0 degrees, still more preferably not less than 17.0 degrees, but not more than 30.0 degrees, more preferably not more than 29.0 degrees, still more preferably not more than 28.0 degrees.

Lie angle θ: if the lie angle θ is too small, the club head rotated around the club shaft axis during swing becomes hard to return at impact, and the ball tends to go right (in the case of right-handed golfer). If the lie angle θ is too large, on the other hand, the club head becomes easy to return overly, and the ball tends to go left (in the case of right-handed golfer).

Therefore, in the case of a driver, the lie angle is preferably not less than 55.0 degrees, more preferably not less than 56.0 degrees, still more preferably not less than 57.0 degrees, but not more than 62.0 degrees, more preferably not more than 61.0 degrees, still more preferably not more than 60.0 degrees.

In the case of a fairway wood, the lie angle is preferably not less than 56.0 degrees, more preferably not less than 57.0 degrees, still more preferably not less than 58.0 degrees, but not more than 63.0 degrees, more preferably not more than 62.0 degrees, still more preferably not more than 61.0 degrees.

In the case of a utility wood, the lie angle is preferably not less than 57.0 degrees, more preferably not less than 58.0 degrees, still more preferably not less than 59.0 degrees, but not more than 63.0 degrees, more preferably not more than 62.0 degrees, still more preferably not more than 61.0 degrees.

Head volume V: If the head volume is too small, as the area of the club face and a moment of inertia of the head decrease, there is a possibility that the flying distance and directionality of the ball decrease. If the head volume is too large, it becomes difficult to hit the ball on the fairway. Therefore, in the case of a driver, the head volume is preferably not less than 400 cc, more preferably not less than 420 cc, still more preferably not less than 440 cc, but not more than 470 cc, more preferably not more than 465 cc, still more preferably not more than 460 cc.

In the case of a fairway wood, the head volume is preferably not less than 100 cc, more preferably not less than 110 cc, still more preferably not less than 120 cc, but not more than 200 cc, more preferably not more than 190 cc, still more preferably not more than 180 cc.

in the case of a utility wood, the head volume is preferably not less than 80 cc, more preferably not less than 90 cc, still more preferably not less than 100 cc, but not more than 150 cc, more preferably not more than 140 cc, still more preferably not more than 130 cc.

Head mass m: If the head mass is too small, as the moment of inertia of the head decreases, the directionality of the ball deteriorated. If the head mass is too large, as the weight balance becomes worse, it becomes hard to use or swing the club, and the flying distance of the ball tends to decrease. Therefore, in the case of a driver, the head mass is preferably not less than 170 g, more preferably not less than 175 g, still more preferably not less than 180 g, but not more than 200 g, more preferably not more than 197 g, still more preferably not more than 194 g.

In the case of a fairway wood, the head mass is preferably not less than 180 g, more preferably not less than 185 g, still more preferably not less than 190 g, but not more than 240 g, more preferably not more than 235 g, still more preferably not more than 230 g.

In the case of a utility wood, the head mass is preferably not less than 200 g, more preferably not less than 205 g, still more preferably not less than 210 g, but not more than 260 g, more preferably not more than 250 g, still more preferably not more than 210 g.

According to the present invention, all of the golf clubs 1 (1A-1C) constituting the club set S satisfy the following conditional expressions (1) and (2):

$$0.75=<\{(L1/L)+0.01\times WL\}=<0.95 \quad (1)$$

$$-22.5=<(\alpha 2-0.65\times WL)=<-20.5 \quad (2)$$

Toe-side crown width L1: If the toe-side crown width L1 is decreased, the highest point P shifts towards the toe. As a result, at address, the toe-side edge of the crown portion 5 appears to approach the axis CL, which gives the golfer a visual impression of upright, thus, gives an impression of hook shot. If the toe-side crown width L1 is increased, the highest point P shifts towards the heel, which gives the golfer a visual impression of flat lie, thus, gives an impression of slice shot. The toe-side crown width L1 is an important parameter which can control the visual impression of the golfer at address.

Crown tilt angle α2: If the crown tilt angle α2 is decreased, the club head gives the golfer a visual impression of flat lie, thus, the golfer is liable to experience an anxiety about slice shot. If the crown tilt angle α2 is increased, the club head gives the golfer a strong visual impression of upright, thus, the golfer is liable to experience an anxiety about hook shot. As explained, the crown tilt angle α2 is also an important parameter which can control the visual impression of the golfer at address.

Figure 4:
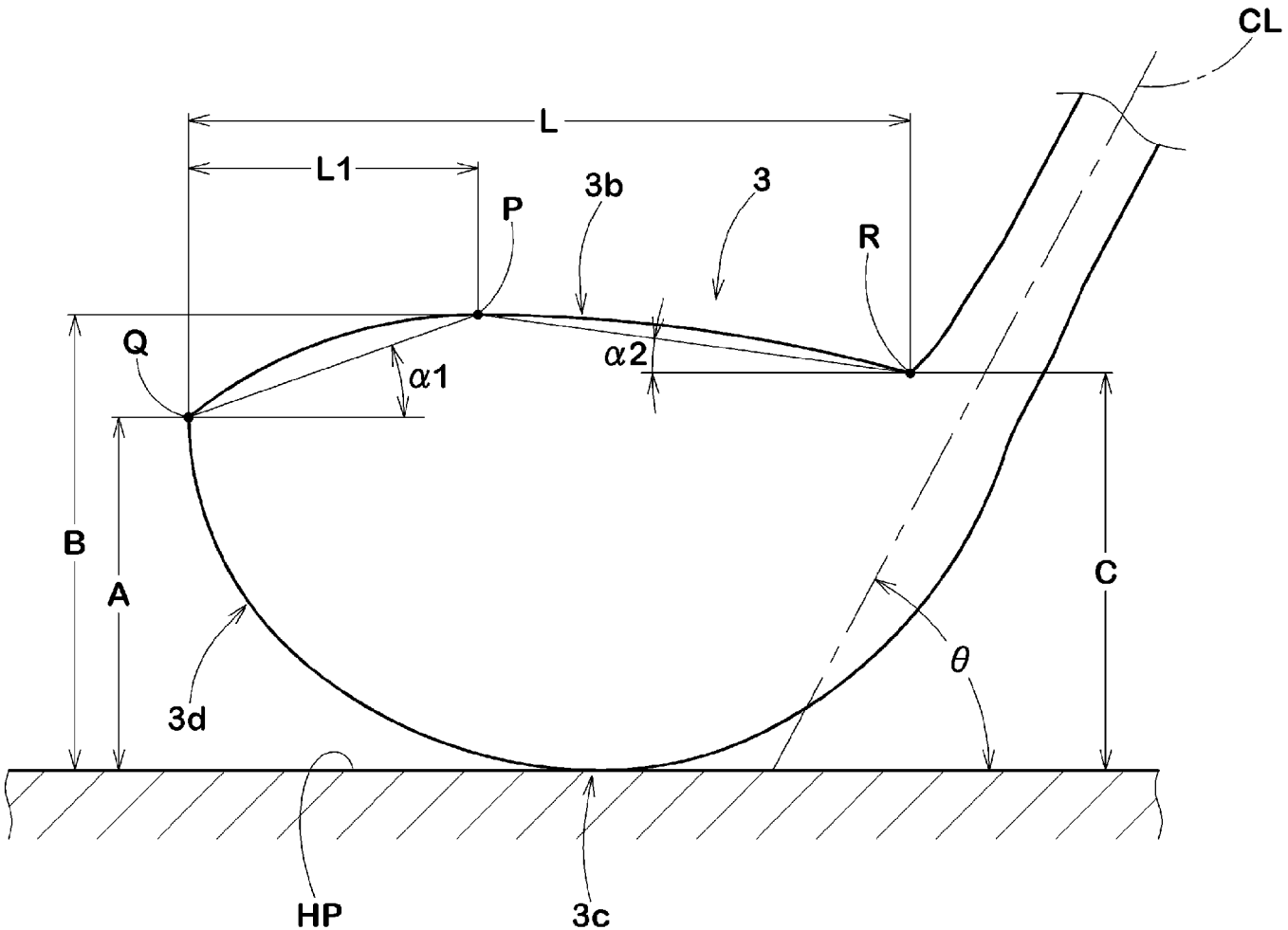
FIG. 4 shows the profile line of the cross section of the head taken along the vertical plane VP.
Figure 5:
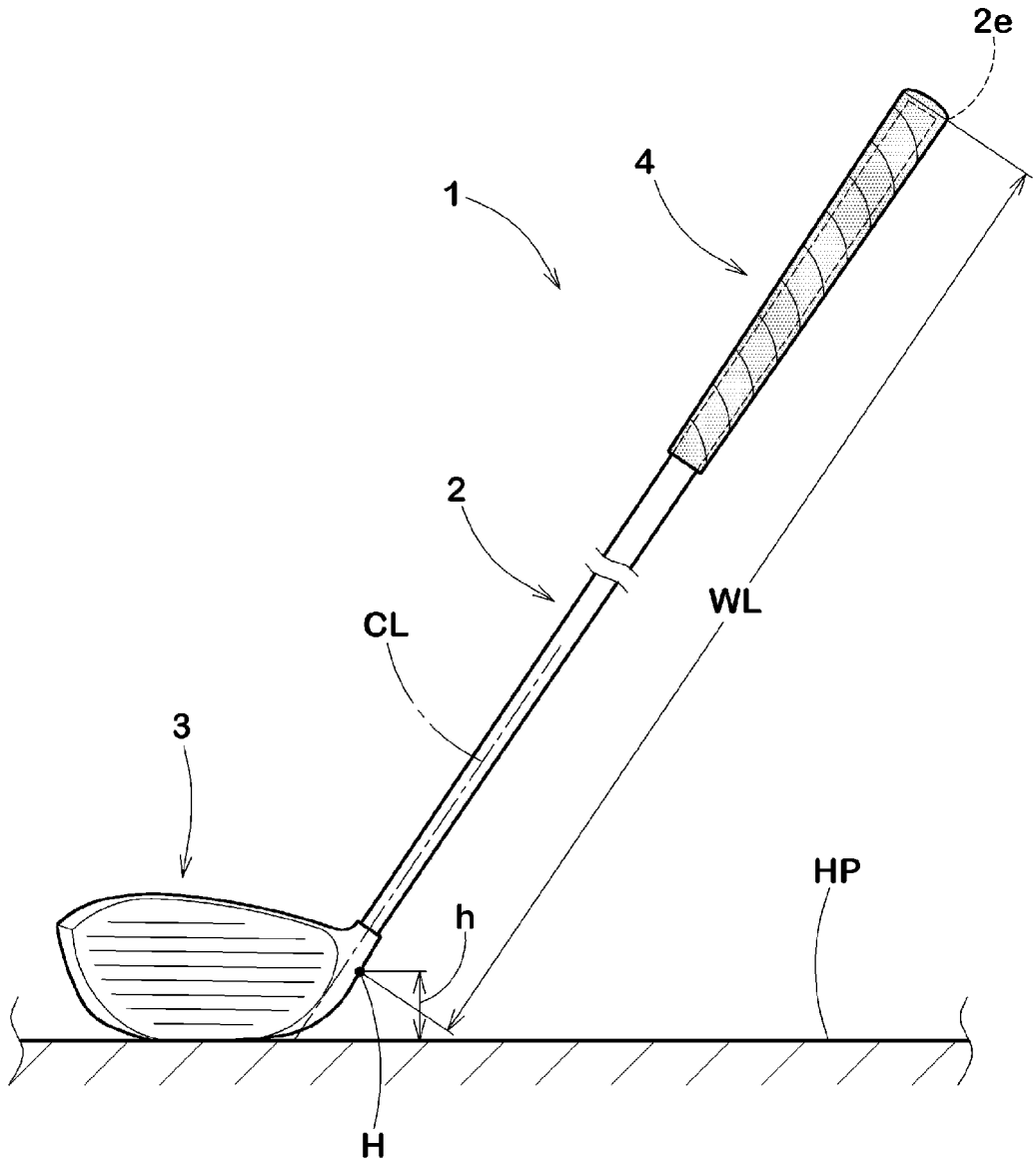
FIG. 5 is a front view of a golf club under the standard state for explaining the club-length.

Toe-side crown angle α1: In FIG. 4 showing the profile line of the cross section of the head taken along the vertical plane VP, a toe-side crown angle α1 is an angle of a straight line drawn between the toe-side extreme end point Q and the highest point P with respect to the horizontal direction.

If the toe-side crown angle α1 is decreased, for the golfer at address, the toe-side portion appears to be less round, and the ridge line between the crown portion 3*b* and side portion 3*d* appears to be less curved. As a result, the golfer receives a strong impression of upright.

If the toe-side crown angle α1 is increased, the toe-side part of the crown portion 3*b* steeply slants downward at address which is liable to give the golfer a strong impression of flat lie.

As shown in FIG. 4, on the profile line of the cross section of the head taken along the vertical plane VP, the outer surface of the crown portion 3*b* is a smoothly curved convex line swelling upward.

If the value of term {(L1/L)+0.01×WL} is less than 0.75, then the toe-side crown width L1 is decreased, and the golf club at address appears to more upright, therefore, the golfer tends to make a hook shot.

If the value of term {(L1/L)+0.01×WL} is more than 0.95, then the toe-side crown width L1 is increased, and the golf club at address appears to be more flat, therefore, the golfer tends to make a slice shot.

Therefore, it is preferable that the value of term {(L1/L)+0.01×WL} is not less than 0.78, more preferably not less than 0.80, but not more than 0.92, more preferably not more than 0.90.

In order to further improve the easiness of swing, preferably the golf clubs constituting the set S are gradually increased in the ratio (L1/L) with the decrease in the club-length WL.

Here, the gradual increase in the ratio (L1/L) does not allow the same value repeated twice. For example, such increase 0.40, 0.42, 0.42, 0.44 is allowed because 0.42 is repeated only once.

If the value of term ($\alpha 2-0.65\times WL$) is less than −22.5, then the crown tilt angle $\alpha 2$ is decreased, and the toe-side portion of the crown portion appears to be less round, and the golfer receives an impression of flat lie, and tends to make a slice shot.

If the value of term ($\alpha 2-0.65\times WL$) is more than −20.5, then the crown tilt angle $\alpha 2$ is increased, and the toe-side portion at address appears to be excessively round, and thus, the golfer receives an impression of upright, and tends to make a hook shot. Therefore, the value of term ($\alpha 2-0.65\times WL$) is preferably not less than −22.0, but not more than −21.0.

Preferably the golf clubs constituting the set S are gradually decrease in the crown tilt angle $\alpha 2$ with the decrease in the club-length WL. The gradual decrease in the crown tilt angle $\alpha 2$ does not allow the same value repeated twice.

Preferably, the toe-side crown width L1 is not less than 20 mm, more preferably not less than 25 mm, still more preferably not less than 30 mm, but not more than 50 mm, more preferably not more than 47 mm, still more preferably not more than 44 mm.

If the toe-side crown width L1 is less than 20 mm, there is a tendency that the club appears to more upright.

If the toe-side crown width L1 is more than 50 mm, there is a tendency that the club appears to be more flat.

Preferably, the overall crown width L is not less than 70 mm, more preferably not less than 75 mm, still more preferably not less than 80 mm, but not more than 130 mm, more preferably not more than 120 mm, still more preferably not more than 115 mm.

If the overall crown width L is less than 70 mm, then the width of the clubface 3*a* in the toe-heel direction is excessively decreased, and the repulsive zone is decreased. As a result, the carry distance of the ball tends to decrease.

If the overall crown width L is more than 130 mm, then the width of the clubface 3*a* in the toe-heel direction is excessively increased, and the mass of the club head is increased on the club face side. As a result, the depth of the center of gravity is decreased, and there is a tendency that the ball launching angle is low and the backspin is high, therefore, the flying distance of the ball tends to decrease.

Further, the crown tilt angle $\alpha 2$ is preferably not less than 3 degrees, more preferably not less than 4 degrees, but not more than 10 degrees, more preferably not more than 9 degrees. If the crown tilt angle $\alpha 2$ is less than 3 degrees, there is a tendency that the club appears to be more flat and the golfer makes a slice shot. If the crown tilt angle $\alpha 2$ is more than 10 degrees, there is a tendency that the club appears to more upright and the golfer makes a hook shot.

Further, the toe-side crown angle $\alpha 1$ is preferably not less than 8 degrees, more preferably not less than 10 degrees, but not more than 20 degrees, more preferably not more than 18 degrees.

If the toe-side crown angle $\alpha 1$ is less than 8 degrees, there is a tendency that the club appears to more upright and the golfer makes a hook shot. If the toe-side crown angle $\alpha 1$ is if more than 20 degrees, there is a tendency that the club appears to be more flat and the golfer makes a slice shot.

Further, it is preferable that, in the profile line of the cross section of the head, the height A from the horizontal plane HP to the toe-side extreme end point Q is not less than 15 mm, more preferably not less than 18 mm, still more preferably not less than 21 mm, but not more than 60 mm, more preferably not more than 55 mm, still more preferably not more than 50 mm. If the height A is less than 15 mm, missed shots occur more often depending on the ability of the golfer. If the height A is if more than 60 mm, the position of the center of gravity of the head becomes high, the ball tends to show a rising trajectory.

For the similar reasons, it is preferable that the height B of the highest point P from the horizontal plane HP is not less than 25 mm, more preferably not less than 28 mm, still more preferably not less than 31 mm, but not more than 70 mm, more preferably not more than 65 mm, still more preferably not more than 60 mm, and the height C of the neck-side lowest point R from the horizontal plane HP is not less than 20 mm, more preferably not less than 24 mm, still more preferably not less than 28 mm, but not more than 60 mm, more preferably not more than 55 mm, still more preferably not more than 50 mm.

Comparison Tests

In order to confirm advantageous effects of the present invention, ten kinds of wood-type golf clubs—driver (W#1), fairway woods (W#3, W#4, W#5, W#6, W#7, W#9) and utility woods (U#5, U#6, U#7, U#8)—having specifications shown in Table 1 were prepared.

Figure 6:
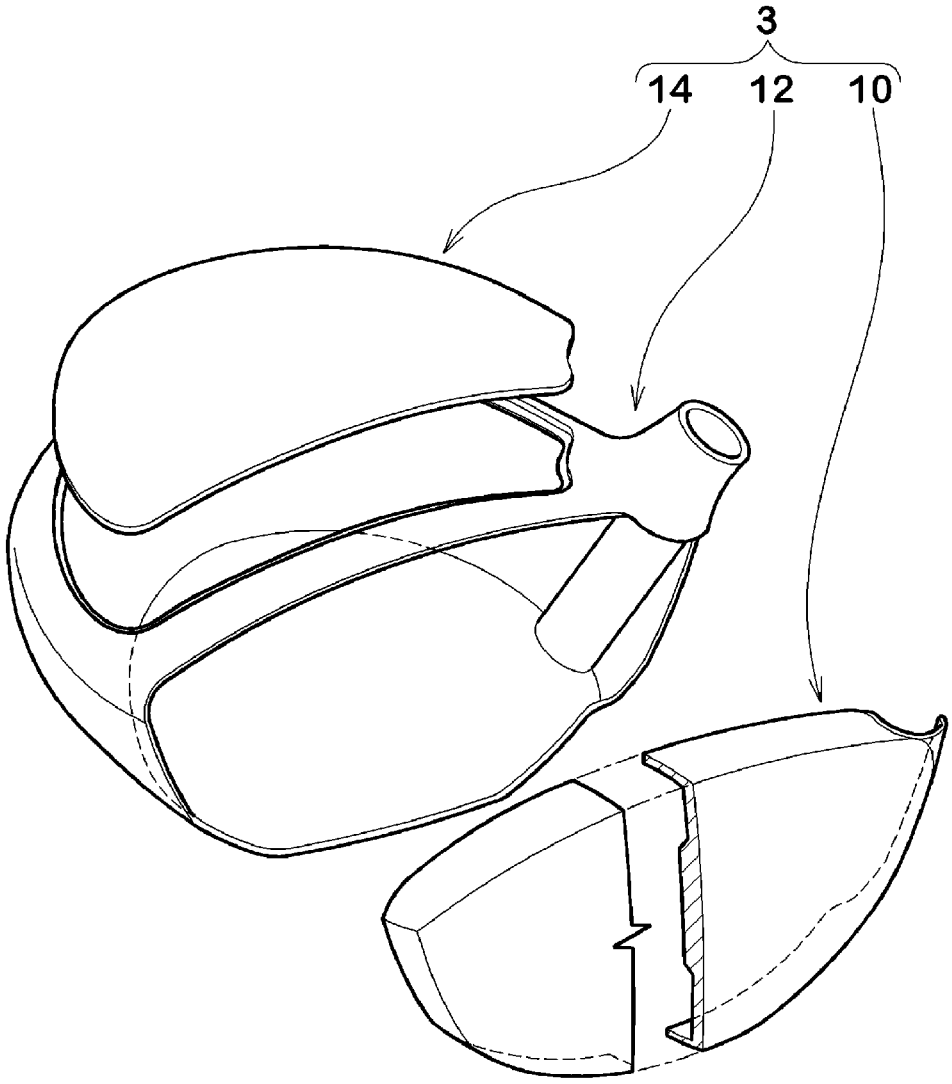
FIG. 6 is an exploded perspective view of a driver according to the present invention.

The driver had a three-piece structure shown in FIG. 6 made up of a main body 12 having a top opening and a front opening, a face plate 10 having a turnback and covering the front opening, and a crown plate 14 covering the top opening. The face plate and crown plate were attached to the main body by plasma welding.

Figure 7:
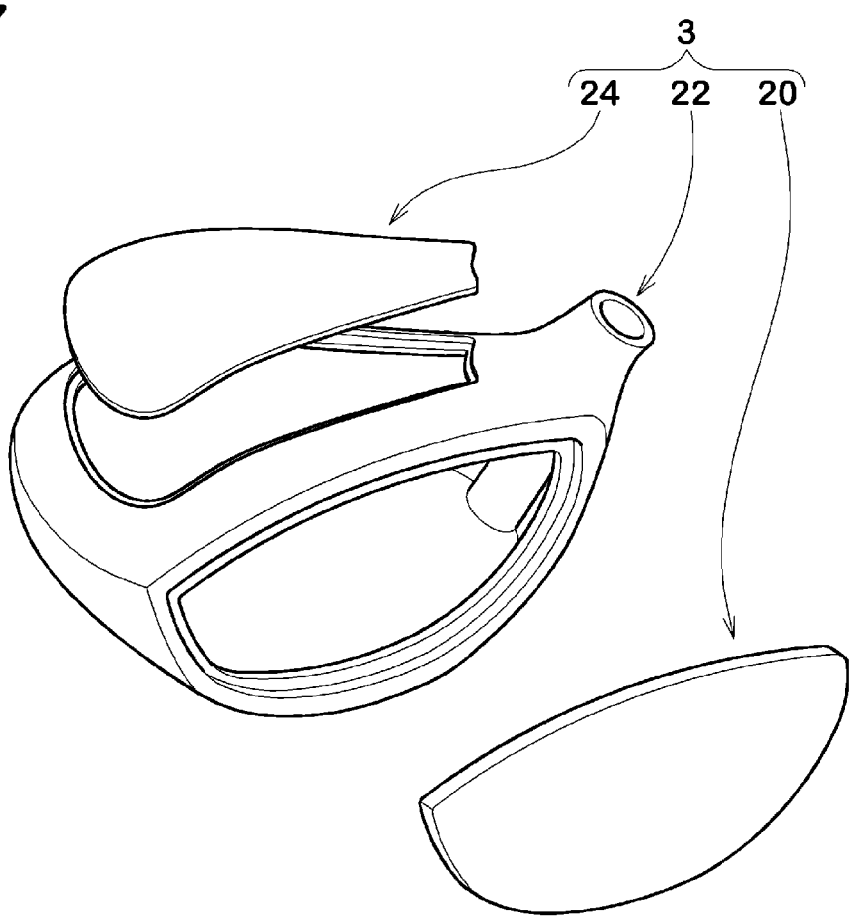
FIG. 7 is an exploded perspective view of a fairway wood according to the present invention.

The fairway wood had a three-piece structure shown in FIG. 7 made up of a main body 22 having a top opening and a front opening, a face plate 20 having no turnback and covering the front opening, and a crown plate 24 covering the top opening. The face plate and crown plate were attached to the main body by soldering.

Figure 8:
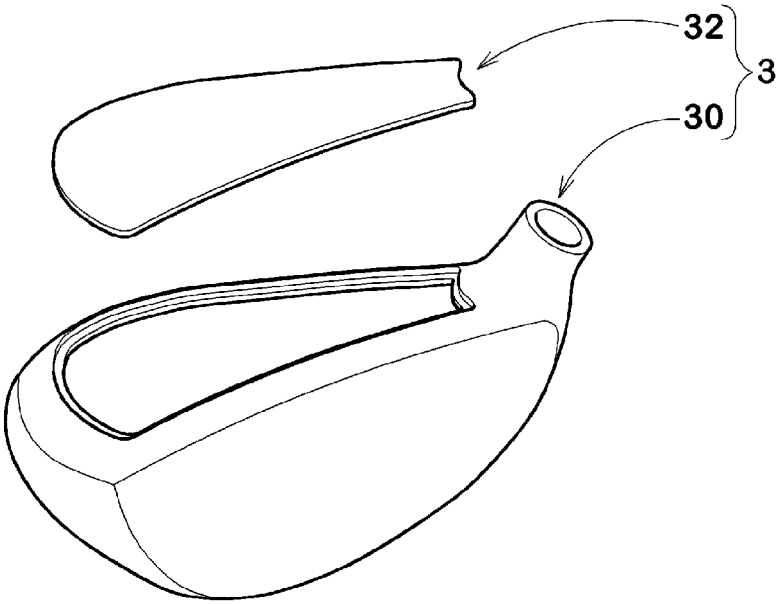
FIG. 8 is an exploded perspective view of a utility wood according to the present invention.

The utility wood had a two-piece structure shown in FIG. 8 made up of a main body 30 having a top opening, and a crown plate 32 covering the top opening. The crown plate was attached to the main body by Tig welding.

The compositions of the materials used are shown in Table 2 and Table 3.

TABLE 1

| Club | Club-length (inch) | Lie angle (deg.) | Loft angle (deg.) | Head volume (cc) | Head mass (g) | Face plate material | Main body material |
|---|---|---|---|---|---|---|---|
| W#1 | 45.75 | 57.5 | 10 | 460 | 192 | Rolled 51AF | 6-4Ti |
| W#3 | 43.0 | 58 | 15 | 164 | 206 | Rolled SP700 | CUSTOM450 |
| W#4 | 42.5 | 58.5 | 16.5 | 154 | 210 | Rolled SP700 | CUSTOM450 |
| W#5 | 42.0 | 59 | 18 | 143 | 215 | Rolled SP700 | CUSTOM450 |
| W#7 | 41.5 | 59.5 | 20 | 135 | 220 | Rolled SP700 | CUSTOM450 |
| W#9 | 41.0 | 60 | 23 | 128 | 224 | Rolled SP700 | CUSTOM450 |
| U#5 | 41.0 | 59 | 17 | 113 | 219 | CUSTOM450 | CUSTOM450 |
| U#6 | 40.5 | 59.5 | 19 | 112 | 224 | CUSTOM450 | CUSTOM450 |
| U#7 | 40.0 | 60 | 21 | 111 | 229 | CUSTOM450 | CUSTOM450 |
| U#8 | 39.5 | 60.5 | 23 | 110 | 234 | CUSTOM450 | CUSTOM450 |

TABLE 2

| Material | Manufacturer | Composition (wt %) | | | | | | | |
|---|---|---|---|---|---|---|---|---|---|
| | | Al | V | Fe | O | C | N | Mo | Ti |
| 51AF | Nippon Steel Corp. | 4.5-5.5 | — | 0.75-1.25 | 0.2 | 0.15 | 0.075 | — | Balance |
| 6-4Ti | Nippon Steel Corp. | 5.5-6.5 | 3.5-4.5 | — | — | 0.01 | 0.01 | — | Balance |
| SP700 | JFE Steel Corp. | 4.5 | 3.0 | 2.0 | — | — | — | 2.0 | Balance |

TABLE 3

| Material | Manufacturer | Composition (wt %) | | | | | | | | | |
|---|---|---|---|---|---|---|---|---|---|---|---|
| | | C | P | Si | Ni | Cu | Fe | Mg | S | Cr | Mo |
| CUSTOM450 | Carpenter Technology Corp. | 0.05 | 0.03 | 1 | 5.0-7.0 | 1.25-1.75 | Balance | 1.0 | 0.03 | 14-16 | 0.5-1.0 |

By combining the above-mentioned wood-type golf clubs, a plurality of wood-type golf club sets including those shown in Table 4 were prepared.

Then the golf clubs in each set were evaluated by ten right-handed golfers having handicaps ranging from 0 to 15. In the evaluation, by hitting golf balls (XXIO XD: manufactured by SRI sports limited) with each club, variations in the ball flying directions were evaluated by each golfer and expressed numerically as follows:

5: go left
4: go slightly left
3: go straight
2: go slightly right
1: go right.

with respect to each club, the evaluated numbers by the ten golfers were averaged, and the average is indicated in "Flying direction" field of Table 4.

Further, in the above evaluation tests, as to whether there was a heterogeneous feeling between the adjacent clubs during swing and at address, each of the club sets was evaluated into three ranks as follows:

1: there is a heterogeneous feeling
2; borderline case
3: there is no heterogeneous feeling.

with respect to each set, the evaluated rank numbers by the ten golfers were averaged, and the average is indicated in "Heterogeneous feeling" field of Table 4.

Form the test results, it can be confirmed that, in comparison with the reference club sets, the Flying directions of the example club sets according to the invention show good points around point 3, and the Heterogeneous feeling is improved. Especially, such improvement is remarkable in the case (cf. Ex. 1) that both of the ratio (L1/L) and angle α2 are gradually changed.

TABLE 4

| | | Golf club set | | | | |
|---|---|---|---|---|---|---|
| | | Ex. 1 | Ex. 2 | Ex. 3 | Ref. 1 | Ref. 2 |
| W#1 | club-length WL (inch) | 45.75 | 45.75 | 45.75 | 45.75 | 45.75 |
| | overall crown width L (mm) | 114 | 114 | 114 | 114 | 114 |
| | toe-side crown width L1 (mm) | 47 | 51 | 44 | 45 | 45 |
| | ratio (L1/L) | 0.41 | 0.45 | 0.39 | 0.39 | 0.39 |
| | crown tilt angle α2 (deg.) | 8.0 | 8.5 | 7.5 | 8.0 | 6.0 |
| | (L1/L) + 0.01 × WL | 0.87 | 0.90 | 0.84 | 0.85 | 0.85 |
| | α2-0.65 × WL | −21.7 | −21.2 | −22.2 | −21.7 | −23.7 |
| | Flying direction | 2.9 | 3.2 | 3.7 | 3.0 | 1.7 |
| W#4 | club-length WL (inch) | 42.50 | 42.50 | 42.50 | 42.50 | 42.50 |
| | overall crown width L (mm) | 88 | 88 | 88 | 88 | 88 |
| | toe-side crown width L1 (mm) | 39 | 41 | 34 | 37 | 48 |
| | ratio (L1/L) | 0.44 | 0.47 | 0.39 | 0.42 | 0.55 |
| | crown tilt angle α2 (deg.) | 6.0 | 6.5 | 5.5 | 8.0 | 6.0 |
| | (L1/L) + 0.01 × WL | 0.87 | 0.89 | 0.81 | 0.85 | 0.97 |
| | α2-0.65 × WL | −21.6 | −21.1 | −22.1 | −19.6 | −21.6 |
| | Flying direction | 3.1 | 3.3 | 2.6 | 4.3 | 4.2 |
| W#7 | club-length WL (inch) | 41.50 | 41.50 | 41.50 | 41.50 | 41.50 |
| | overall crown width L (mm) | 83 | 83 | 83 | 83 | 83 |
| | toe-side crown width L1 (mm) | 37 | 35 | 30 | 35 | 25 |
| | ratio (L1/L) | 0.45 | 0.42 | 0.36 | 0.42 | 0.30 |
| | crown tilt angle α2 (deg.) | 5.5 | 5.0 | 4.5 | 8.0 | 5.0 |
| | (L1/L) + 0.01 × WL | 0.86 | 0.84 | 0.78 | 0.84 | 0.72 |
| | α2-0.65 × WL | −21.5 | −22.0 | −22.5 | −19.0 | −22.0 |
| | Flying direction | 3.2 | 2.7 | 2.1 | 4.2 | 2.0 |
| U#6 | club-length WL (inch) | 40.50 | 40.50 | 40.50 | 40.50 | 40.50 |
| | overall crown width L (mm) | 82 | 82 | 82 | 82 | 82 |
| | toe-side crown width L1 (mm) | 38 | 36 | 31 | 28 | 29 |
| | ratio (L1/L) | 0.46 | 0.44 | 0.38 | 0.34 | 0.35 |
| | crown tilt angle α2 (deg.) | 4.5 | 5.0 | 4.0 | 3.0 | 4.0 |

TABLE 4-continued

| | | Golf club set | | | | |
|---|---|---|---|---|---|---|
| | | Ex. 1 | Ex. 2 | Ex. 3 | Ref. 1 | Ref. 2 |
| | (L1/L) + 0.01 × WL | 0.87 | 0.84 | 0.78 | 0.75 | 0.76 |
| | α2-0.65 × WL | −21.8 | −21.3 | −22.3 | −23.3 | −22.3 |
| | Flying direction | 3.1 | 3.0 | 2.4 | 1.8 | 2.3 |
| U#8 | club-length WL (inch) | 39.50 | 39.50 | 39.50 | 39.50 | 39.50 |
| | overall crown width L (mm) | 81.5 | 81.5 | 81.5 | 81.5 | 81.5 |
| | toe-side crown width L1 (mm) | 39 | 41 | 39 | 41 | 45 |
| | ratio (L1/L) | 0.48 | 0.50 | 0.48 | 0.50 | 0.55 |
| | crown tilt angle α2 (deg.) | 4.0 | 4.0 | 5.0 | 5.0 | 5.5 |
| | (L1/L) + 0.01 × WL | 0.87 | 0.90 | 0.87 | 0.90 | 0.95 |
| | α2-0.65 × WL | −21.7 | −21.7 | −20.7 | −20.7 | −20.2 |
| | Flying direction | 2.9 | 3.2 | 3.5 | 3.5 | 4.4 |
| L1/L | W#1 | 0.41 | 0.45 | 0.39 | 0.39 | 0.39 |
| | W#4 | 0.44 | 0.47 | 0.39 | 0.42 | 0.55 |
| | W#7 | 0.45 | 0.42 | 0.36 | 0.42 | 0.30 |
| | U#6 | 0.46 | 0.44 | 0.38 | 0.34 | 0.35 |
| | U#8 | 0.48 | 0.50 | 0.48 | 0.50 | 0.55 |
| α2 | W#1 | 8.0 | 8.5 | 7.5 | 8.0 | 6.0 |
| | W#4 | 6.0 | 6.5 | 5.5 | 8.0 | 6.0 |
| | W#7 | 5.5 | 5.0 | 4.5 | 8.0 | 5.0 |
| | U#6 | 4.5 | 5.0 | 4.0 | 3.0 | 4.0 |
| | U#8 | 4.0 | 4.0 | 5.0 | 5.0 | 5.5 |
| | Heterogeneous feeling | 2.9 | 2.7 | 2.4 | 1.9 | 1.4 |

The invention claimed is:

1. A set of wood-type golf clubs having different club-lengths, each of which has a club-length WL in inches, a toe-side crown width L1 in millimeter, an overall crown width L in millimeter, and a crown tilt angle α2 in degree which satisfy the following conditional expressions:

$$0.75=<\{(L1/L)+0.01\times WL\}=<0.95$$

and $$-22.5=<(\alpha 2-0.65\times WL)=<-20.5,$$

wherein the ratio (L1/L) of the toe-side crown width L1 to the overall crown width L is gradually increased with the decrease in the club-length.

2. A set of wood-type golf clubs having different club-lengths, each of which has a club-length WL in inches, a toe-side crown width L1 in millimeter, an overall crown width L in millimeter, and a crown tilt angle α2 in degree which satisfy the following conditional expressions:

$$0.75=<\{(L1/L)+0.01\times WL\}=<0.95$$

and $$-22.5=<(\alpha 2-0.65\times WL)=<-20.5,$$

wherein the crown tilt angle α2 is gradually decreased with the decrease in the club-length.

3. A set of wood-type golf clubs having different club-lengths, each of which has a club-length WL in inches, a toe-side crown width L1 in millimeter, an overall crown width L in millimeter, and a crown tilt angle α2 in degree which satisfy the following conditional expressions:

$$0.75=<\{(L1/L)+0.01\times WL\}=<0.95$$

and $$-22.5=<(\alpha 2-0.65\times WL)=<-20.5,$$

wherein with the decrease in the club-length, the ratio (L1/L) of the toe-side crown width L1 to the overall crown width L is gradually increased, and the crown tilt angle α2 is gradually decreased.

4. The set according to claim 1 2, or 3, wherein the toe-side crown width L1 is not less than 20 mm but not more than 50 mm.

5. The set according to claim 1 2, or 3, wherein the overall crown width L is not less than 70 mm but not more than 130 mm.

6. The set according to claim 1 2, or 3, wherein the crown tilt angle α2 is not less than 3 degrees but not more than 10 degrees.

7. The set according to claim 3, wherein said wood-type golf clubs include a driver, a fairway wood and a utility wood.

8. The set according to claim 7, wherein the club-length WL of the driver is not less than 43.5 inches but not more than 48.0 inches, the club-length WL of the fairway wood is not less than 39.0 inches but not more than 44.0 inches, and the club-length WL of the utility wood is not less than 38.0 inches but not more than 42.0 inches.

9. The set according to claim 7, wherein a loft angle of the driver is not less than 7.5 degrees but not more than 16.0 degrees, a loft angle of the fairway wood is not less than 11.0 degrees but not more than 26.0 degrees and a loft angle of the utility wood is not less than 15.0 degrees but not more than 30.0 degrees.

10. The set according to claim 7, wherein a lie angle of the driver is not less than 55.0 degrees but not more than 62.0 degrees, a lie angle of the fairway wood is not less than 56.0 degrees but not more than 63.0 degrees and a lie angle of the utility wood is not less than 57.0 degrees but not more than 63.0 degrees.

11. The set according to claim 7, wherein a head volume of the driver is not less than 400 cc but not more than 470 cc, a head volume of the fairway wood is not less than 100 cc but not more than 200 cc and a head volume of the utility wood is not less than 80 cc but not more than 150 cc.

12. The set according to claim 7, wherein a head mass of the driver is not less than 170 g but not more than 200 g, a the head mass of the fairway wood is not less than 180 g but not more than 240 g and a head mass of the utility wood is not less than 200 g but not more than 260 g.

13. The set according to claim 7, wherein a toe-side crown angle $\alpha 1$ is not less than 8 degrees but not more than 20 degrees.

14. The set according to claim 7, wherein a height A of a toe-side extreme end point Q is not less than 15 mm but not more than 60 mm.

15. The set according to claim 7, wherein a height B of a crown highest point P is not less than 25 mm but not more than 70 mm.

* * * * *